US010497297B2

(12) United States Patent
Chen et al.

(10) Patent No.: US 10,497,297 B2
(45) Date of Patent: Dec. 3, 2019

(54) ELECTRONIC DEVICE WITH AMBIENT-ADAPTIVE DISPLAY

(71) Applicant: Apple Inc., Cupertino, CA (US)

(72) Inventors: Wei Chen, Palo Alto, CA (US); Jiaying Wu, San Jose, CA (US); Lu Zhang, West Lafayette, IN (US); Cheng Chen, San Jose, CA (US)

(73) Assignee: Apple Inc., Cupertino, CA (US)

( * ) Notice: Subject to any disclaimer, the term of this patent is extended or adjusted under 35 U.S.C. 154(b) by 189 days.

(21) Appl. No.: 15/248,989

(22) Filed: Aug. 26, 2016

(65) Prior Publication Data

US 2017/0263174 A1 Sep. 14, 2017

Related U.S. Application Data

(60) Provisional application No. 62/305,774, filed on Mar. 9, 2016.

(51) Int. Cl.
*G09G 3/20* (2006.01)

(52) U.S. Cl.
CPC ... *G09G 3/2003* (2013.01); *G09G 2320/0242* (2013.01); *G09G 2320/0626* (2013.01); *G09G 2360/144* (2013.01)

(58) Field of Classification Search
None
See application file for complete search history.

(56) References Cited

U.S. PATENT DOCUMENTS

2007/0052735 A1* 3/2007 Chou ..... H04N 9/69 345/690
2008/0303918 A1 12/2008 Kiethley
2009/0040170 A1* 2/2009 Nilsson ..... H04N 5/58 345/101
2011/0012937 A1* 1/2011 Onishi ..... G09G 3/3426 345/690
2014/0071102 A1 3/2014 Pieper et al.
2014/0210802 A1 7/2014 Myers et al.
2014/0333656 A1* 11/2014 Wang ..... G09G 5/02 345/591
2015/0070337 A1 3/2015 Bell et al.
2016/0063951 A1 3/2016 Ikizyan et al.
2016/0180780 A1 6/2016 Chen et al.
2017/0202070 A1* 7/2017 Dong ..... G09G 3/3413

* cited by examiner

*Primary Examiner* — Amare Mengistu
*Assistant Examiner* — Sarvesh J Nadkarni
(74) *Attorney, Agent, or Firm* — Treyz Law Group, P.C.; Kendall W. Abbasi

(57) ABSTRACT

An electronic device may be provided with a display, display control circuitry that operates the display, and a color ambient light sensor that gathers ambient light information. Display color cast may be adjusted based on the ambient light information. When the color of ambient light is within an acceptable range of colors, the color cast of the display may be adjusted to more closely match the color of ambient light. When the color of ambient light is outside of the acceptable range of colors, display control circuitry may determine an adjusted ambient light color that is within the acceptable range. The adjusted ambient light color may have the same color temperature as the measured ambient light color. After determining an adjusted ambient light color that is within the acceptable range, the color cast of the display may be adjusted to more closely match the adjusted ambient light color.

19 Claims, 9 Drawing Sheets

ELECTRONIC DEVICE WITH AMBIENT-ADAPTIVE DISPLAY

This application claims the benefit of provisional patent application No. 62/305,774, filed Mar. 9, 2016, which is hereby incorporated by reference herein in its entirety.

BACKGROUND

This relates generally to electronic devices, and, more particularly, to light sensors for electronic devices.

Electronic devices such as laptop computers, cellular telephones, and other equipment are sometimes provided with light sensors. For example, ambient light sensors may be incorporated into a device to provide the device with information on current lighting conditions. Ambient light readings may be used in controlling the device. If, for example bright daylight conditions are detected, an electronic device may increase display brightness to compensate.

Ambient light sensors can sometimes produce erroneous readings. For example, a user's finger or other external object may block an ambient light sensor. In this type of situation, the ambient light sensor may produce a reading that does not accurately reflect ambient lighting conditions. If care is not taken, this may lead to inappropriate display adjustments.

It would therefore be desirable to be able to provide improved systems for operating displays in electronic devices.

SUMMARY

An electronic device may be provided with a display and display control circuitry. A color ambient light sensor may make measurements of ambient light intensity and color through a window in an inactive border region of the display.

The white point and color cast of the display may be adjusted based on ambient light information. When the measured color of ambient light is within an acceptable range of ambient light colors, the display control circuitry may adjust the color cast of the display to more closely match the measured color of ambient light. When the measured color of ambient light is outside of the acceptable range of ambient light colors, the display control circuitry may determine an adjusted ambient light color that is within the acceptable range of ambient light colors. The adjusted ambient light color may have the same color temperature as the measured ambient light color, but may be less saturated than the measured ambient light color. The adjusted ambient light color may have chromaticity coordinates that are located on a Planckian locus.

After determining an adjusted ambient light color that is within the acceptable range, the color cast of the display may be adjusted to more closely match the adjusted ambient light color.

DETAILED DESCRIPTION

Figure 1:
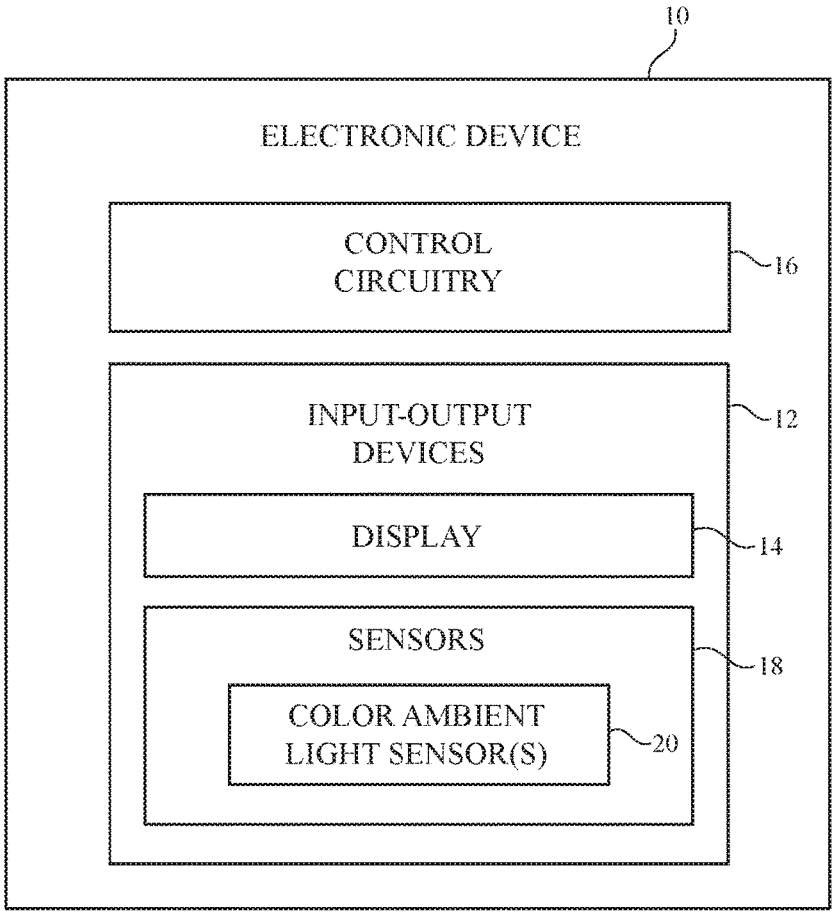
FIG. 1 is a schematic diagram of an illustrative electronic device in accordance with an embodiment.

An illustrative electronic device of the type that may be provided with one or more light sensors is shown in FIG. 1. Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Input-output devices 12 may also include sensors 18. Sensors 18 may include an ambient light sensor such as color ambient light sensors 20 and other sensors (e.g., a capacitive proximity sensor, a light-based proximity sensor, a magnetic sensor, an accelerometer, a force sensor, a touch sensor, a temperature sensor, a pressure sensor, a compass, a microphone or other sound sensor, or other sensors).

Color ambient light sensor 20 for device 10 may have an array of detectors each of which is provided with a color filter. If desired, the detectors in ambient light sensor 20 may be provided with color filters of different respective colors. Information from the detectors may be used to measure the total amount of ambient light that is present in the vicinity of device 10. For example, the ambient light sensor may be used to determine whether device 10 is in a dark or bright environment. Based on this information, control circuitry 16 can adjust display brightness for display 14 or can take other suitable action.

Ambient light sensors 20 may be used to make ambient light intensity (brightness) measurements. Ambient light intensity measurements, which may sometimes be referred to as ambient light luminance measurements, may be used by device 10 to adjust display brightness (as an example). Ambient light sensors 20 may be used to make measurements of ambient light color (e.g., color coordinates, correlated color temperature, or other color parameters representing ambient light color). Processing circuitry 16 may be used to convert these different types of color information to other formats, if desired (e.g., a set of red, green, and blue sensor output values may be converted into color chromaticity coordinates and/or may be processed to produce an associated correlated color temperature, etc.).

Color information and brightness information from color sensing ambient light sensor 20 can be used to adjust the operation of device 10. For example, the color cast of display 14 may be adjusted in accordance with the color of ambient lighting conditions. If, for example, a user moves device 10 from a cool lighting environment to a warm lighting environment (e.g., an incandescent light environment), the warmth of display 14 may be increased accordingly, so that the user of device 10 does not perceive display 14 as being overly cold. If desired, the ambient light sensor may include an infrared light sensor. In general, any suitable actions may be taken based on color measurements and/or total light intensity measurements (e.g., adjusting display brightness, adjusting display content, changing audio and/or video settings, adjusting sensor measurements from other sensors, adjusting which on-screen options are presented to a user of device 10, adjusting wireless circuitry settings, etc.).

Figure 2:
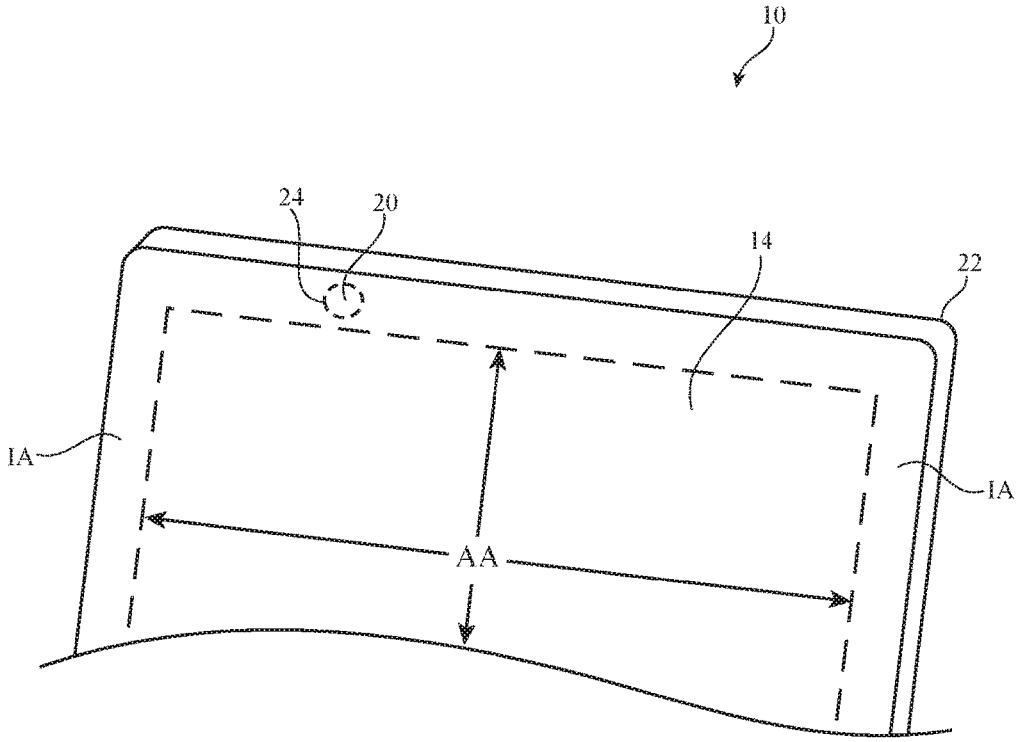
FIG. 2 is a front perspective view of a portion of an illustrative electronic device in accordance with an embodiment.

A perspective view of a portion of an illustrative electronic device is shown in FIG. 2. In the example of FIG. 2, device 10 includes a display such as display 14 mounted in housing 22. Housing 22, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 22 may be formed using a unibody configuration in which some or all of housing 22 is machined or molded as a single structure or may be formed using multiple structures (e.g., an internal frame structure, one or more structures that form exterior housing surfaces, etc.).

Display 14 may be protected using a display cover layer such as a layer of transparent glass, clear plastic, sapphire, or other clear layer. Openings may be formed in the display cover layer. For example, an opening may be formed in the display cover layer to accommodate a button, a speaker port, or other components. Openings may be formed in housing 22 to form communications ports (e.g., an audio jack port, a digital data port, etc.), to form openings for buttons, etc.

Display 14 may include an array of display pixels formed from liquid crystal display (LCD) components, an array of electrophoretic pixels, an array of plasma pixels, an array of organic light-emitting diode pixels or other light-emitting diodes, an array of electrowetting pixels, or pixels based on other display technologies. The array of pixels of display 14 forms an active area AA. Active area AA is used to display images for a user of device 10. Active area AA may be rectangular or may have other suitable shapes. Inactive border area IA may run along one or more edges of active area AA. Inactive border area IA may contain circuits, signal lines, and other structures that do not emit light for forming images. To hide inactive circuitry and other components in border area IA from view by a user of device 10, the underside of the outermost layer of display 14 (e.g., the display cover layer or other display layer) may be coated with an opaque masking material such as a layer of black ink. Optical components (e.g., a camera, a light-based proximity sensor, an ambient light sensor, status indicator light-emitting diodes, camera flash light-emitting diodes, etc.) may be mounted under inactive border area IA. One or more openings (sometimes referred to as windows) may be formed in the opaque masking layer of IA to accommodate the optical components. For example, a light component window such as an ambient light sensor window may be formed in a peripheral portion of display 14 such as region 24 in inactive border area IA. Ambient light from the exterior of device 10 may be measured by ambient light sensor 20 in device 10 after passing through region 24 and the display cover layer.

Figure 3:
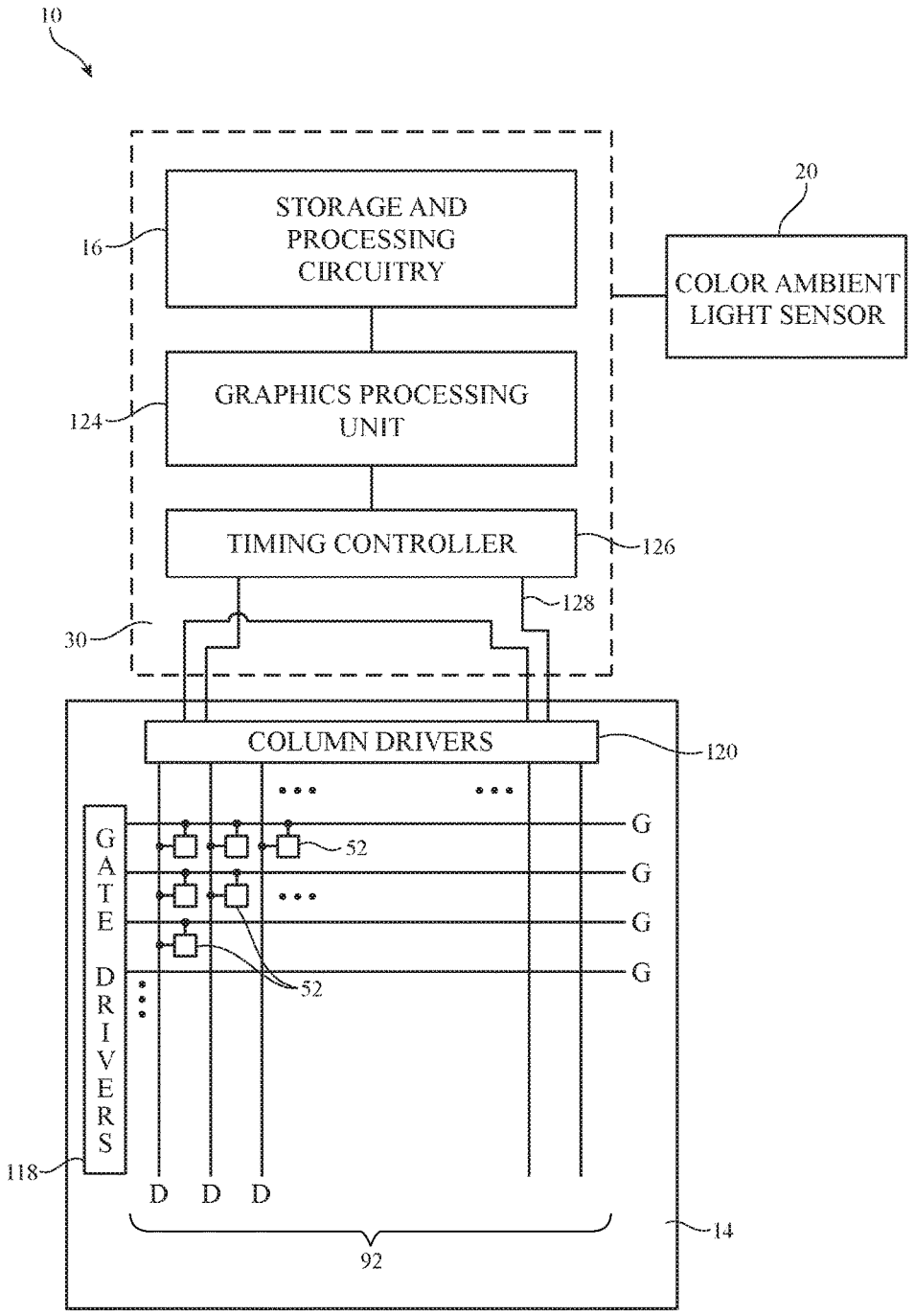
FIG. 3 is a schematic diagram of an illustrative electronic device having a display, display control circuitry, and a color ambient light sensor in accordance with an embodiment.

FIG. 3 is a diagram of device 10 showing illustrative circuitry that may be used in displaying images for a user of device 10 on pixel array 92 of display 14. As shown in FIG. 3, display 14 may have column driver circuitry 120 that drives data signals (analog voltages) onto the data lines D of array 92. Gate driver circuitry 118 drives gate line signals onto gate lines G of array 92. Using the data lines and gate lines, display pixels 52 may be configured to display images on display 14 for a user. Gate driver circuitry 118 may be implemented using thin-film transistor circuitry on a display substrate such as a glass or plastic display substrate or may be implemented using integrated circuits that are mounted on the display substrate or attached to the display substrate by a flexible printed circuit or other connecting layer. Column driver circuitry 120 may be implemented using one or more column driver integrated circuits that are mounted on the display substrate or using column driver circuits mounted on other substrates.

During operation of device 10, storage and processing circuitry 16 may produce data that is to be displayed on display 14. This display data may be provided to display control circuitry such as timing controller integrated circuit 126 using graphics processing unit 124.

Timing controller 126 may provide digital display data to column driver circuitry 120 using paths 128. Column driver circuitry 120 may receive the digital display data from timing controller 126. Using digital-to-analog converter circuitry within column driver circuitry 120, column driver circuitry 120 may provide corresponding analog output signals on the data lines D running along the columns of display pixels 52 of array 92.

Storage and processing circuitry 16, graphics processing unit 124, and timing controller 126 may sometimes collectively be referred to herein as display control circuitry 30. Display control circuitry 30 may be used in controlling the operation of display 14.

Pixels 52 may include color pixels such as red (R) pixels, green (G) pixels, blue pixels (B) pixel, white (W) pixels, and/or pixels of other colors. Arrangements in which pixels 52 include a pattern of red, green, and blue pixels are sometimes described herein as an illustrative example. Color pixels may include color filter elements that transmit light of a particular color or color pixels may be formed from emissive elements that emit light of a particular color Display control circuitry 30 and associated thin-film transistor circuitry associated with display 14 may be used to produce signals such as data signals and gate line signals for operating pixels 52 (e.g., turning pixels 52 on and off, adjusting the intensity of pixels 52, etc.). During operation, display control circuitry 30 may control the values of the data signals and gate signals to control the light intensity associated with each of the display pixels and to thereby display images on display 14.

Display control circuitry 30 may produce red, green, and blue pixel values (sometimes referred to as RGB values or digital display control values) corresponding to the color to be displayed by a given pixel. The RGB values may be converted into analog display signals for controlling the brightness of each pixel. The RGB values (e.g., integers with values ranging from 0 to 255) may correspond to the desired pixel intensity of each pixel. For example, a digital display control value of 0 may result in an "off" pixel, whereas a digital display control value of 255 may result in a pixel operating at a maximum available power and brightness.

If desired, each color channel may have eight bits, six bits, or any other suitable number of bits. In arrangements where each color channel has eight bits, the digital display control values that control each pixel may be integers ranging from 0 to 255. In arrangements where each color channel has six bits, the digital display control values that control each pixel may be integers ranging from 0 to 64. Arrangements in which each color channel has eight bits are sometimes described herein as an illustrative example.

Display control circuitry 30 may gather ambient light sensor data from color ambient light sensor 20 to adaptively determine how to adjust display light and display colors based on ambient lighting conditions. If desired, display control circuitry 30 may control display 14 using other information such as time information from a clock, calendar, and/or other time source, location information from location detection circuitry (e.g., Global Positioning System receiver circuitry, IEEE 802.11 transceiver circuitry, or other location detection circuitry), user input information from a user input device such as a touchscreen (e.g., touchscreen display 14) or keyboard, etc.

Ambient light sensors 20 may be used to measure the color and intensity of ambient light. Display control circuitry 30 may adjust the operation of display 14 based on the color and intensity of ambient light. In adjusting the output from display 14, display control circuitry 30 may take into account the chromatic adaptation function of the human visual system. This may include, for example, adjusting the white point of display 14 based on the color and/or brightness of ambient light measured by ambient light sensor 20. If, for example, a user moves device 10 from a cool lighting environment (e.g., outdoor light having a relatively high correlated color temperature) to a warm lighting environment (e.g., indoor light having a relatively low correlated color temperature), the "warmth" of display 14 may be increased accordingly by adjusting the white point of display 14 to a warmer white (e.g., a white with a cooler color temperature), so that the user of device 10 does not perceive display 14 as being overly cold.

Figure 4:
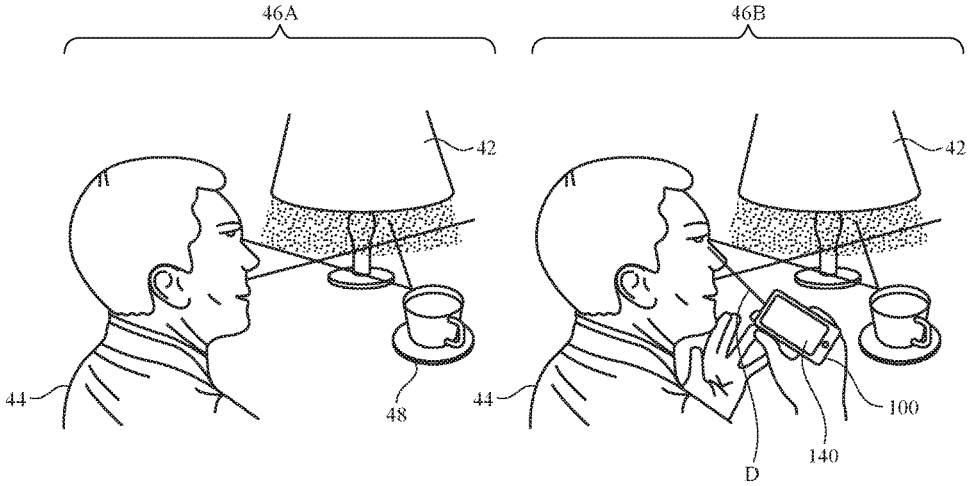
FIG. 4 is a diagram illustrating how conventional displays do not adapt to the color of ambient light and become unsightly to a user as a result.

FIG. 4 is a diagram illustrating the effects of using a conventional display that does not take into account the chromatic adaptation of human vision. Conventional displays such as display 140 of device 100 typically have a fixed target white point such as D65 (a standard illuminant defined by the International Commission on Illumination). In scenario 46A, user 44 observes external objects 48 under illuminant 42 (e.g., an indoor light source that generates warm light). The vision of user 44 adapts to the color and brightness of the ambient lighting conditions. Scenario 46B represents how a user perceives light from display 140 of device 100 after having adapted to the color and brightness of illuminant 42. Because the white point of display 140 remains fixed at D65, device 100 does not account for the chromatic adaptation of human vision, and display 140 appears bluish and unsightly to user 44 as a result.

To avoid the perceived discoloration of display 14, display control circuitry 30 of FIG. 3 may control the white point and color cast of display 14 based on the color (and intensity, if desired) of ambient light. This may include, for example, adaptively adjusting the white point of display 14 to have a color that more closely matches the color of ambient light.

Figure 5:
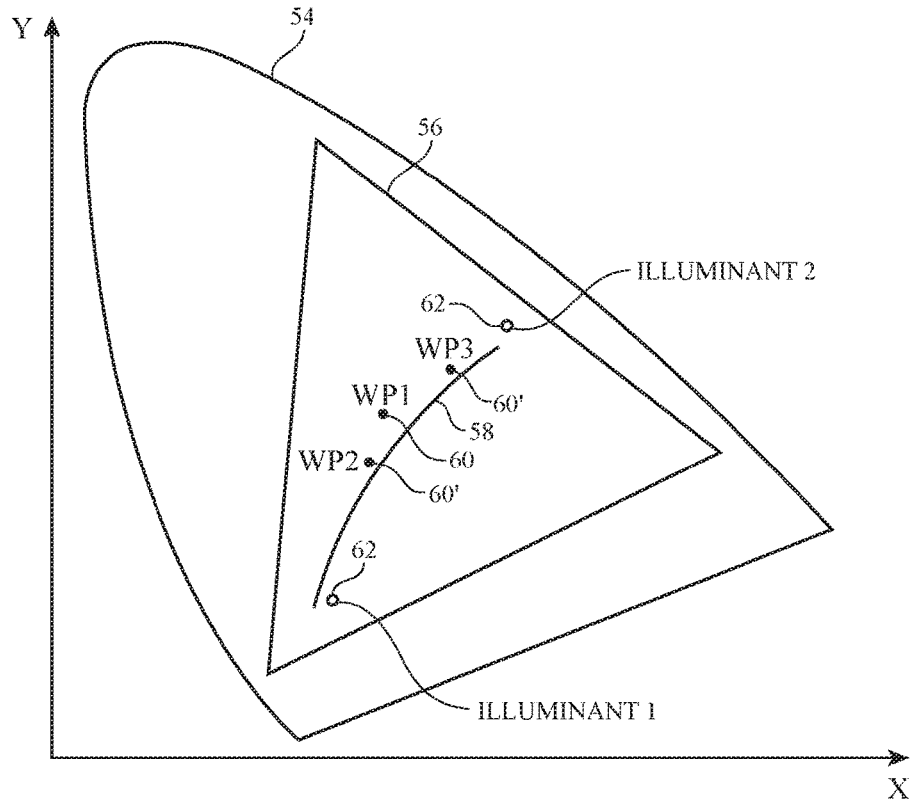
FIG. 5 is a chromaticity diagram illustrating how the white point of a display may be adjusted based on the color of ambient light in accordance with an embodiment.

A chromaticity diagram illustrating how display 14 may have an adaptive white point that is determined at least partly based on ambient lighting conditions is shown in FIG. 5. The chromaticity diagram of FIG. 5 illustrates a two-dimensional projection of a three-dimensional color space (sometimes referred to as the 1931 CIE chromaticity diagram). The color generated by a display such as display 14 may be represented by chromaticity values x and y. The chromaticity values may be computed by transforming, for example, three color intensities (e.g., intensities of colored light emitted by a display) such as intensities of red, green, and blue light into three tristimulus values X, Y, and Z and normalizing the first two tristimulus values X and Y (e.g., by computing $x=X/(X+Y+Z)$ and $y=Y/(X+Y+Z)$ to obtain normalized x and y values). Transforming color intensities into tristimulus values may be performed using transformations defined by the International Commission on Illumination (CIE) or using any other suitable color transformation for computing tristimulus values.

Any color generated by a display may therefore be represented by a point (e.g., by chromaticity values x and y) on a chromaticity diagram such as the diagram shown in FIG. 5. Bounded region 54 of FIG. 5 represents the limits of visible light that may be perceived by humans (i.e., the total available color space). The colors that may be generated by a display are contained within a subregion of bounded region 54. For example, bounded region 56 may represent the available color space for display 14 (sometimes referred to as the color gamut of display 14).

Display 14 may be characterized by various calibration settings such as gamma and color temperature. The color temperature of display 14 determines the color cast of display 14. Although the color temperature setting of a display can affect the appearance of all colors, the color temperature setting of a display is sometimes referred to as the "white point" of the display because it is defined by the white color produced when all of the pixels in a display are operated at full power (e.g., when R=G=B=255). The white point of display 14 may be defined by an illuminant (e.g., D65, D50, or other illuminant), a color temperature (e.g., 6500 degrees Kelvin (K), 5000 K, or other color temperature), or a set of chromaticity coordinates. The color temperature of a light source refers to the temperature at which a theoretical black body radiator would emit radiation of a color most closely resembling that of the light source. Curve 58 illustrates the range of colors that would radiate from an ideal black body at different color temperatures and is sometimes referred to as the Planckian locus or black body locus. The color temperatures on black body curve 58 range from higher temperatures on the left (e.g., near the cooler hues around Illuminant 1) to lower temperatures on the right (e.g., near the warmer hues around Illuminant 2).

Display control circuitry 30 of FIG. 3 may operate display 14 in an ambient-adaptive mode and a non-adaptive mode. In ambient-adaptive mode, display control circuitry 30 may adaptively adjust the white point of display 14 based on the color of ambient light. In non-adaptive mode, the white point of display 14 may remain fixed at a default white point such as WP1 (represented by point 60 of FIG. 5). Display control circuitry 30 may switch between ambient-adaptive mode and non-adaptive mode automatically and/or a user may manually adjust the settings of display 14 to switch between ambient-adaptive mode and non-adaptive mode.

The default white point WP1 of display 14 may be any suitable white point. For example, white point WP1 may be D65, D50, or any other suitable white color. If desired, white point WP1 may be selected and/or adjusted by the user. When operating in non-adaptive mode, the white point of display 14 may remain fixed at WP1 even as the ambient lighting conditions change.

In ambient-adaptive mode, however, display control circuitry 30 may automatically adjust the white point of display 14 based on the color of ambient light. There may be certain ambient lighting situations where the default white point WP1 is appropriate. For example, when ambient light is neither overly cool nor overly warm, default white point WP1 may be a close match to the ambient light and may therefore be agreeable to the user's eyes. However, under other ambient lighting conditions (e.g., under different illuminants such as illuminants 62 of FIG. 5), display control circuitry 30 may adjust the white point of display 14 to an ambient-adaptive white point (e.g., one of ambient-adaptive white points 60' of FIG. 5).

For example, under a first ambient illuminant 62 such as Illuminant 1, control circuitry 30 may adjust the white point of display 14 to ambient-adapted white point WP2 (represented by one of points 60'). Ambient-adapted white point WP2 more closely matches the color of Illuminant 1 than default white point WP1. Under a second ambient illuminant 62 such as Illuminant 2, control circuitry 30 may adjust the white point of display 14 to ambient-adapted white point WP3 (represented by another one of points 60'). Ambient-adapted white point WP3 more closely matches the color of Illuminant 2 than default white point WP1.

By adjusting the white point of display 14 based on the color of ambient light, the color cast of display 14 will adapt to the different ambient lighting conditions just as the user's vision chromatically adapts to different ambient lighting conditions. For example, Illuminant 2 may correspond to an indoor light source having a warm hue, whereas Illuminant 1 may correspond to daylight having a cool hue. Illuminant 2 may have a lower color temperature than Illuminant 1 and may therefore emit warmer light. In warmer ambient light (e.g., under Illuminant 2), display control circuitry 30 can adjust the white point of display 14 to ambient-adapted white point WP3, which in turn adjusts the color cast of display 14 to produce warmer light (i.e., light with a lower color temperature) than that which would be produced if the default white point WP1 were maintained as the display white point.

In addition to helping avoid perceived color shifts in different ambient lighting conditions, this type of adaptive color adjustment may also have beneficial effects on the human circadian rhythm. The human circadian system may respond differently to different wavelengths of light. For example, when a user is exposed to blue light having a peak wavelength within a particular range, the user's circadian system may be activated and melatonin production may be suppressed. On the other hand, when a user is exposed to light outside of this range of wavelengths or when blue light is suppressed (e.g., compared to red light), the user's melatonin production may be increased, signaling nighttime to the body.

Conventional displays do not take into account the spectral sensitivity of the human circadian rhythm. For example, some displays emit light having spectral characteristics that trigger the circadian system regardless of the time of day, which can in turn have an adverse effect on sleep quality.

In contrast, by using the color cast adjustment method described in connection with FIG. 5, the ambient-adapted white point of display 14 may become warmer in warmer ambient lighting conditions (e.g., may be adjusted to white point WP3 or other suitable warm white). Thus, when a user is at home in the evening (e.g., reading in warm ambient light), blue light emitted from display 14 may be suppressed (e.g., relative to other colors) as the display adapts to the warm ambient lighting conditions. The reduction in blue light may in turn reduce suppression of the user's melatonin production (and, in some scenarios, may increase the user's melatonin production) to promote better sleep.

Figure 6:
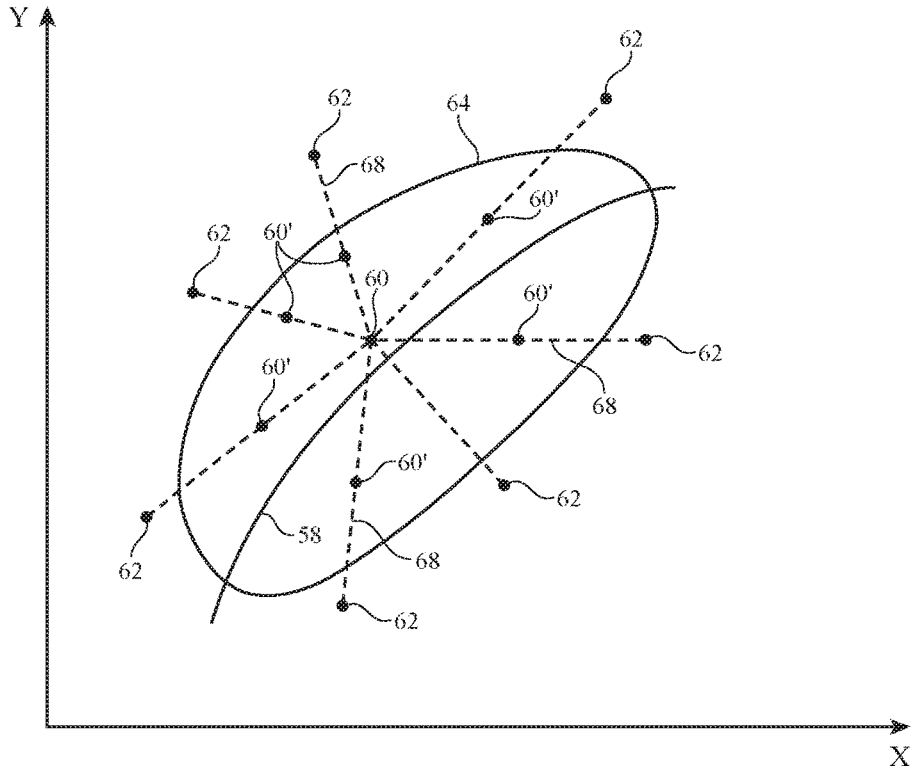
FIG. 6 is a chromaticity diagram illustrating how an ambient-adapted white point may be determined based on the measured ambient light color in accordance with an embodiment.

FIG. 6 shows an illustrative method of determining an ambient-adaptive white point 60' using measured ambient light data 62. Each data point 62 represents chromaticity coordinates associated with a measured ambient light color. For example, in arrangements where ambient light sensor 20 has a red detector, a green detector, and a blue detector, sensor 20 may output red, green, and blue values corresponding to measured ambient light. Display control circuitry 30 may convert these red, green, and blue sensor values to corresponding tristimulus values X, Y, and Z, which in turn may be converted to chromaticity coordinates represented by data points 62 in FIG. 6.

After measuring the color of ambient light, display control circuitry 30 may determine an ambient-adapted neutral point 60' based on the color of measured ambient light 62 and the default target white point 60. The ambient-adapted white point may be located along line 68 between default white point 60 and measured ambient light color 62. Although line 68 is shown in CIEXYZ color space, line 68 may be a line between default white point 60 and ambient light color 62 in any suitable color space. In one illustrative example, line 68 may represent a line between default white point 60 and ambient light color 62 in CIELAB color space.

If desired, other color spaces may be used (LMS color space, CIELUV color space, CIEXYZ color space, or other suitable color space).

The location of ambient-adapted white point 60' on line 68 may depend on various factors. In some configurations, the white point may be adjusted to be the same as or close to the ambient light color 62. However, some ambient light colors may be too far from default white point 60 and would therefore appear unsightly to a user. In order to avoid having the color cast of display 14 appear too yellow or too blue, display control circuitry 30 may impose constraints on the distance between default white point 60 and ambient-adapted white point 60'. These constraints are represented by bounded region 64. Line 64 represents the furthest acceptable distance that an ambient-adapted white point 60' may be from default white point 60. This is, however, merely illustrative. If desired, display control circuitry 30 may match ambient-adapted white point 60' to ambient light 62 without imposing any constraints (e.g., ambient-adapted white point 60' may be located outside of boundary 64, if desired).

The ambient-adapted white point 60' may therefore be located anywhere along line 68 between default white point 60 and boundary line 64. The location of the ambient-adapted white point 60' along line 68 may be determined based on various factors. Since display 14 is itself illuminant, a user's chromatic adaptation may be affected by both display light from display 14 and ambient light from other light sources (e.g., the sun, a light bulb, etc.). Display control circuitry 30 may use an adaptation factor ranging from 0 to 1 to determine how heavily the display light should be weighted relative to other ambient light sources when determining ambient-adapted white point 60'. When a user's vision is assumed to be completely adapted to display light without adapting to ambient light from surrounding light sources (e.g., when a user is viewing display 14 in a dark room), the adaptation factor may be equal to one. Conversely, when a user's vision is assumed to be completely adapted to the surrounding ambient light without adapting to the display light, the adaptation factor may be equal to zero. Adaptation factors between 0 and 1 may indicate that the user's vision is adapting to a mix of display light and other ambient light sources.

In some arrangements, display control circuitry 30 may use a look-up table (LUT) that is stored in device 10 to determine ambient-adapted white point 60' based on ambient light color 62. The look-up table may have output ambient-adapted white points 60' that are indexed by measured ambient light 62. If desired, the output ambient-adapted white points 60' may be indexed by other variables such as the adaptation factor described above, the time of day, user preferences, or other suitable factors. If desired, equations or other mapping methods may be used instead of or in addition to look-up tables to determine an ambient-adapted white point 60' based on measured ambient light color 62.

When display control circuitry 30 is operating display 14 in ambient-adaptive mode, care must be taken to ensure that the ambient-adaptive white point of display 14 is not overly red or blue. There may be scenarios in which the output from ambient light sensor 20 does not accurately represent the color of ambient light. For example, a user's hand may be covering ambient light sensor 20, or a red shirt may be directly in front of ambient light sensor 20. If display control circuitry 30 were to adjust the white point of display 14 to match these types of sensor readings, the color cast if display 14 may appear too yellow or red to the user.

Figure 7:
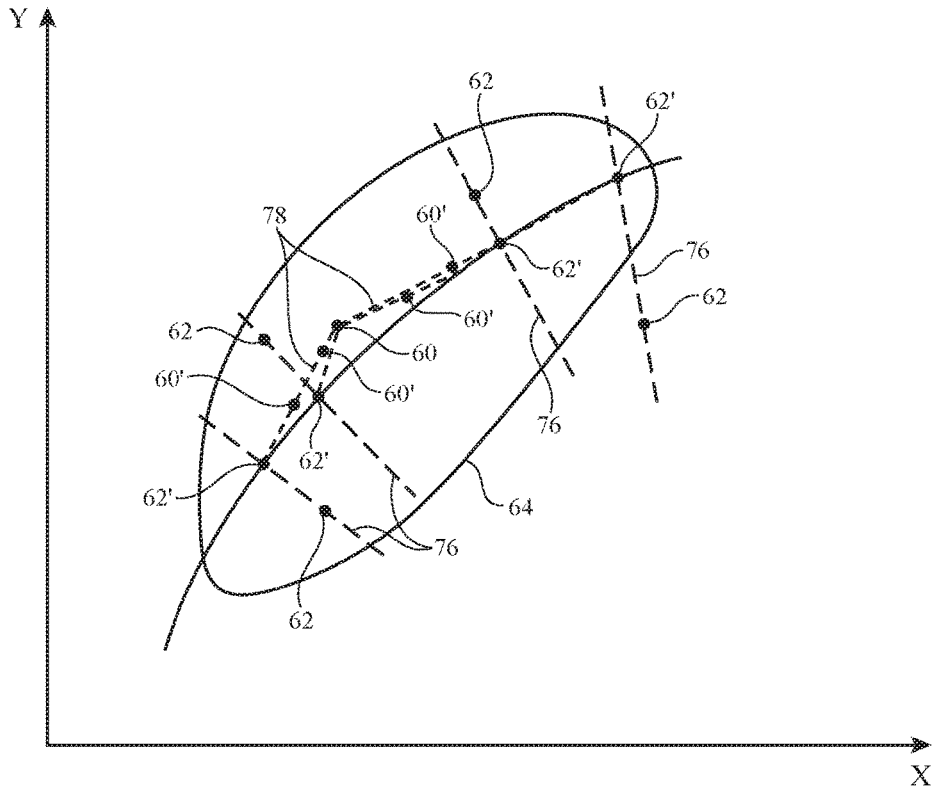
FIG. 7 is a chromaticity diagram illustrating how measured ambient light colors may be adjusted to less saturated ambient light colors before determining an ambient-adapted white point in accordance with an embodiment.

FIG. 7 illustrates a method of adjusting the white point of display 14 in a way that compensates for less accurate ambient light sensor readings. The chromaticity coordinates of most ambient light sources are located on or close to black body curve 58. Colors that are further from black body curve 58 may be more saturated than colors on black body curve 58. For example, colors below black body curve 58 may be more intensely red saturated than colors on curve 58. Thus, to ensure that display control circuitry 30 does not adjust the white point of display 14 to match a sensor reading 62 that is overly saturated and not representative of the actual ambient light color, display control circuitry 30 may map ambient light sensor readings 62 to black body curve 58 before determining an appropriate ambient-adapted white point 60'.

Each line 76 represents a range of colors that share the same color temperature (sometimes referred to as an iso-CCT line). Point 62' represents the point on black body curve 58 with a color temperature that matches the color temperature associated with ambient light sensor reading 62. When display control circuitry 30 receives an ambient light sensor reading 62, it can convert the sensor output values to a color temperature. Display control circuitry 30 may then determine the point 62' on black body curve 58 that has the same color temperature as the measured ambient light color 62. After mapping ambient light colors 62 to acceptable ambient light colors 62' on black body curve 58, display control circuitry 30 may determine an appropriate ambient-adapted white point 60' for display 14 using ambient light color 62' as the ambient light color.

Display control circuitry 30 may, for example, use a method of the type described in connection with FIG. 6 to determine an ambient-adapted white point 60' based on the adjusted ambient light color 62' and the default white point 60. For example, the ambient-adapted white point 60' may be located along line 78 between default white point 60 and adjusted ambient light color 62'. Line 78 may be a line between CIEXYZ color space, CIELAB color space, LMS color space, CIELUV color space, or other suitable color space. If desired, display control circuitry 30 may impose certain constraints to ensure that the ambient-adapted white point 60' is located within an acceptable distance from default white point 60 (e.g., so that ambient-adapted white point 60' is located within bounded region 64).

The example of FIG. 7 in which all ambient light sensor readings 62 are mapped to colors of equal color temperature on black body curve 58 is merely illustrative. If desired, control circuitry 30 may only adjust ambient light sensor readings 62 that lie outside of an acceptable range of colors before determining an ambient-adapted white point 60. This type of arrangement is described in FIG. 8.

Figure 8:
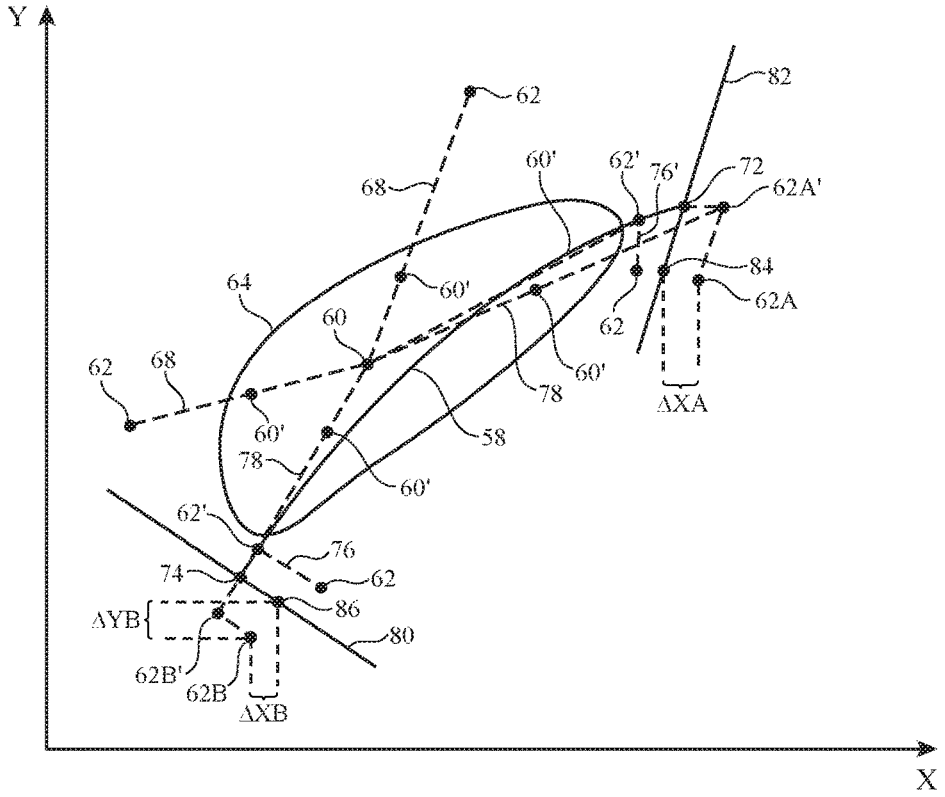
FIG. 8 is a chromaticity diagram illustrating how measured ambient light colors that fall outside of a predetermined range of colors may be adjusted to less saturated ambient light colors before determining an ambient-adapted white point in accordance with an embodiment.

FIG. 8 illustrates a method of determining an ambient-adapted white point for display 14 in which some ambient light sensor readings 62 are processed using the method of FIG. 6 and other ambient light sensor readings 62 are processed using the method of FIG. 7. This type of hybrid approach allows display control circuitry 30 to adjust the color cast of display 14 to closely match ambient light surroundings while still avoiding overly harsh adjustments that may make the display appear too yellow or red.

For example, when ambient light sensor 20 is covered by a user's hand or a red shirt, ambient light sensor 20 may produce ambient light data 62 with chromaticity coordinates below black body curve 58. It may therefore be desirable to map ambient light sensor readings 62 that are located below black body curve 58 to a color on black body curve 58 with equal color temperature, as described in connection with FIG. 7. Colors on black body curve 58 may be less saturated than colors below black body curve 58. As another example, if users tend to dislike displays with overly yellow color casts, ambient light sensor readings 62 that are overly yellow may be mapped to black body curve 58 prior to determining an ambient-adapted white point 60'. In general, ambient light sensor readings of any given color or within any given region of the color spectrum may be mapped to black body curve 58 prior to determining an ambient-adapted white point 60'.

In the example of FIG. 8, ambient light sensor readings 62 that are located below black body curve 58 on the chromaticity diagram are mapped to an acceptable color on black body curve 58 and are processed using the method of FIG. 7. Ambient light sensor readings 62 that are located above black body curve 58 on the chromaticity diagram are deemed to be acceptable and are processed using the method of FIG. 6.

There may be scenarios in which ambient light sensor measurements correspond to a highly saturated color that does not have a matching color temperature on black body curve 58. For example, blackbody curve 58 may range from about 2,248 K at point 72 on black body curve 58 to 15,000 K at point 74 on black body curve 58. Line 82 represents a range of colors that share the 2,248 K color temperature and is sometimes referred to as the 2,248 K iso-CCT line. Line 80 represents a range of colors that share the 15,000 K color temperature and is sometimes referred to as the 15,000 K iso-CCT line. Some ambient light sensor measurements such as measurements 62A and 62B may have color temperatures that are outside of the 2,248 K to 15,000 K temperature range. Display control circuitry 30 may apply special processing steps to these outlier measurements to determine an acceptable ambient light color that is less saturated than the measured ambient light color 62A or 62B.

For ambient light sensor measurements below 2,248 K such as measurement 62A, display control circuitry 30 may determine the x-component ΔXA of the distance between point 62A and the closest point 84 on 2,248 K iso-CCT line 82. The adjusted ambient light color 62A' for this measurement may then be determined by adding ΔXA to the x-component of point 72 (the 2,248 K temperature location on black body curve 58). Adding only to the x-component of point 72 may help ensure that the adjusted ambient light color 62A' does not shift downward into the red portion of the color spectrum. In effect, black body curve 58 is extended in the x-direction beyond point 72 to determine an appropriate ambient light color for color temperatures lower than 2,248 K. This is, however, merely illustrative. If desired, ambient light color 62A' may be determined by adding to point 72 both the x-component and the y-component of the difference between point 62A and point 84.

For ambient light sensor measurements above 15,000 K such as measurement 62B, display control circuitry 30 may determine the x-component ΔXB and the y-component ΔYB of the distance between point 62B and the closest point 86 on 15,000 K iso-CCT line 80. The adjusted ambient light color 62B' for this measurement may then be determined by adding ΔXB to the x-component of point 74 (the 15,000 K temperature location on black body curve 58) and by adding ΔYB to the y-component of point 74. In effect, black body curve 58 is extrapolated using the tangent slope of curve 58 at point 74 to determine an appropriate ambient light color for color temperatures higher than 15,000 K.

Ambient light sensor measurements 62 that are within the acceptable portion of the color space (e.g., measurements 62 above black body curve 58) may be processed using the method described in connection with FIG. 6. For example, for measurements 62 above black body curve 58, ambient-adapted white point 60' may be located along line 68 between default white point 60 and ambient light color 62. Line 68 may be a line between CIEXYZ color space, CIELAB color space, LMS color space, CIELUV color space, or other suitable color space. If desired, display control circuitry 30 may impose certain constraints to ensure that the ambient-adapted white point 60' is located within an acceptable distance from default white point 60 (e.g., so that ambient-adapted white point 60' is located within bounded region 64). If desired, a look-up table may be used to determine ambient-adapted white point 60' based on ambient light color 62.

Ambient light sensor measurements 62 that are not within the acceptable portion of the color space (e.g., measurements 62 below black body curve 58) may be processed using the method described in connection with FIG. 7. For example, display control circuitry 30 may first map these ambient light sensor measurements 62 to acceptable ambient light colors 62' by determining the point on curve 58 with the same color temperature as ambient light color 62. Display control circuitry 30 may then use the adjusted ambient light color 62' to determine ambient-adapted white point 60. Ambient-adapted white point 60' may be located along line 78 between default white point 60 and adjusted ambient light color 62'. Line 78 may be a line between CIEXYZ color space, CIELAB color space, LMS color space, CIELUV color space, or other suitable color space. If desired, display control circuitry 30 may impose certain constraints to ensure that the ambient-adapted white point 60' is located within an acceptable distance from default white point 60 (e.g., so that ambient-adapted white point 60' is located within bounded region 64). If desired, a look-up table may be used to determine ambient-adapted white point 60' based on adjusted ambient light color 62'.

Figure 9:
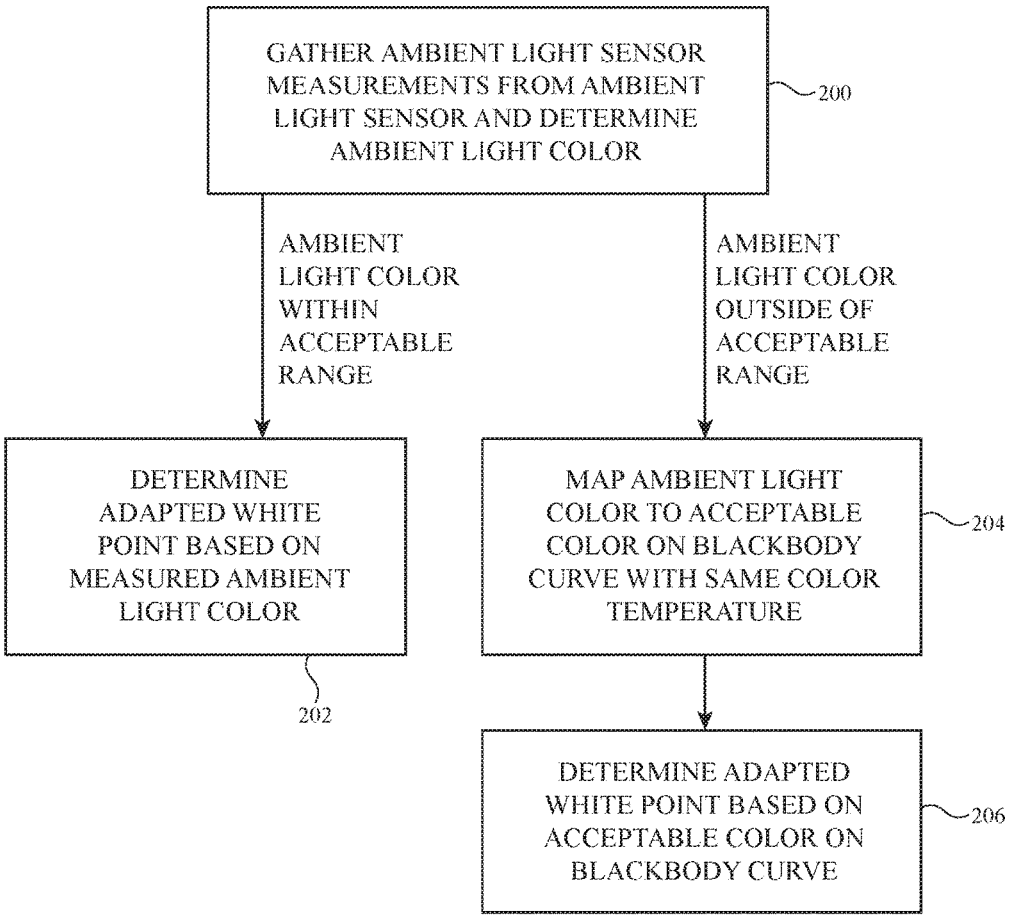
FIG. 9 is a flow chart of illustrative steps involved in determining an ambient-adapted white point for a display using a technique of the type shown in FIG. 8 in accordance with an embodiment.

FIG. 9 is a flow chart of illustrative steps involved in determining an ambient-adapted white point for display 14 based on the color of ambient light.

At step 200, display control circuitry 30 may use color ambient light sensor 20 to gather intensity information and color information on ambient light. Color information (i.e., color ambient light sensor color data) may be gathered as color coordinates, correlated color temperature (CCT) readings, or using other suitable color sensing parameters. During the operations of step 200, the ambient light sensor measurements may be processed. For example, red, green, and blue sensor output values may be converted to chromaticity coordinates (e.g., chromaticity coordinates 62 of FIGS. 6, 7, and 8) representing the color of ambient light.

During the operations of step 200, display control circuitry 30 may determine whether the ambient light color is within a predetermined acceptable range of colors. For example, ambient light colors that are located above black body curve 58 may be deemed "acceptable," whereas ambient light colors that are located below black body curve 58 may be too red and may need adjustment to a less saturated color before being used to determine an ambient-adapted white point for display 14. The use of black body curve 58 to separate acceptable ambient light colors from unacceptable ambient colors that need to be adjusted is merely illustrative. Whether an ambient light color is acceptable may be based on other factors or constraints. For example, some ambient light colors below black body curve 58 may be deemed acceptable, whereas other colors below curve 58 (e.g., saturated red colors) may be deemed unacceptable and in need of adjustment.

If it is determined during step 200 that the ambient light color is within the acceptable range of colors, display control circuitry 30 may process the ambient light sensor data using the operations of step 202. At step 202, display control circuitry 30 may determine an ambient-adapted white point 60' based on the ambient light color 62 measured in step 200. This may include, for example, applying an equation, look-up table (e.g., a 1D LUT, a 3D LUT, or other suitable LUT), or other mapping method using ambient light color 62 to determine an ambient-adapted white point 60' that more closely matches ambient light color 62. In some scenarios, the ambient-adapted white point 60' may have a color that matches ambient light color 62. In other scenarios, the ambient-adapted white point 60' may be a color between default white point 60 and ambient light color 62 (e.g., in CIELAB color space or other suitable color space).

If it is determined during step 200 that the ambient light color is not within the acceptable range of colors, display control circuitry 30 may process the ambient light sensor data using the operations of step 204. At step 204, display control circuitry 30 may adjust the measured ambient light color 62 to an acceptable ambient light color 62'. This may include, for example, determining the color temperature associated with the measured ambient light color 62 and then determining the color 62' on black body curve 58 with that same color temperature. The adjusted ambient light color may, for example, be less saturated than the measured ambient light color. For ambient light colors that do not have a matching color temperature on black body curve 58 (e.g., measurements with color temperatures outside of the 2,248 K to 15,000 K range such as measurements 62A and 62B of FIG. 8), the measured ambient light color may be mapped to a color on an "extended" or extrapolated portion of black body curve as described in connection with FIG. 8 (e.g., acceptable colors 62A' and 62B' of FIG. 8).

At step 206, display control circuitry 30 may determine an ambient-adapted white point 60' based on the adjusted ambient light color 62' determined in step 204. This may include, for example, applying an equation, look-up table, or other mapping method using adjusted ambient light color 62' to determine an ambient-adapted white point 60' that more closely matches adjusted ambient light color 62'. In some scenarios, the ambient-adapted white point 60' may have a color that matches adjusted ambient light color 62'. In other scenarios, the ambient-adapted white point 60' may be a color between default white point 60 and adjusted ambient light color 62' (e.g., in CIELAB color space or other suitable color space).

The foregoing is merely illustrative and various modifications can be made by those skilled in the art without departing from the scope and spirit of the described embodiments. The foregoing embodiments may be implemented individually or in any combination.

What is claimed is:

1. A method of operating a display in an electronic device having a color ambient light sensor that receives ambient light and having display control circuitry, comprising:

with the display control circuitry, gathering ambient light sensor data using the color ambient light sensor;

with the display control circuitry, processing the ambient light sensor data to determine a measured ambient light color;

with the display control circuitry, mapping the measured ambient light color to an adjusted ambient light color, wherein the adjusted ambient light color and the measured ambient light color have the same color temperature and different chromaticity values; and with the display control circuitry, adjusting a white point of the display based on the adjusted ambient light color.

2. The method defined in claim 1 wherein processing the ambient light sensor data to determine the measured ambient light color comprise processing the ambient light sensor data to determine the color temperature of the ambient light.

3. The method defined in claim 2 wherein determining the adjusted ambient light color based on the measured ambient light color comprises determining the adjusted ambient light color based on the color temperature of the ambient light.

4. The method defined in claim 2 wherein the adjusted ambient light color has chromaticity coordinates that are located on a Planckian locus on a chromaticity diagram.

5. The method defined in claim 4 wherein the measured ambient light color has chromaticity coordinates that are located below the Planckian locus on the chromaticity diagram.

6. The method defined in claim 2 wherein determining the adjusted ambient light color based on the measured ambient light color comprises determining whether the color temperature of the ambient light falls within a predetermined range of color temperatures.

7. The method defined in claim 6 wherein the display control circuitry determines the adjusted ambient light color by extrapolating from a Planckian locus when the color temperature of the ambient light falls outside of the predetermined range of color temperatures.

8. The method defined in claim 6 wherein the predetermined range of color temperatures comprises color temperatures between 2,248 K and 15,000 K.

9. The method defined in claim 1 wherein the adjusted ambient light color is less saturated than the measured ambient light color.

10. The method defined in claim 1 wherein adjusting the white point of the display comprises automatically adjusting the color cast of the display based on the adjusted ambient light color.

11. The method defined in claim 1 wherein adjusting the white point of the display comprises shifting the white point of the display from a first white point to a second white point, wherein the second white point more closely matches the adjusted ambient light color than the first white point.

12. A method of operating a display in an electronic device having a color ambient light sensor and display control circuitry, comprising:

with the display control circuitry, gathering ambient light sensor data using the color ambient light sensor;

with the display control circuitry, determining a measured ambient light color based on the ambient light sensor data;

with the display control circuitry, determining whether the measured ambient light color is within an acceptable range of ambient light colors, wherein the acceptable range of ambient light colors have different chromaticity values and equal color temperatures; and with the display control circuitry, determining an ambient-adapted white point for the display based on the measured ambient light color and based on whether the measured ambient light color is within the acceptable range of ambient light colors.

13. The method defined in claim 12 further comprising:

in response to determining that the measured ambient light color is outside of the acceptable range of ambient light colors, determining an acceptable ambient light color based on the measured ambient light color, wherein the acceptable ambient light color is within the acceptable range of ambient light colors.

14. The method defined in claim 13 wherein the acceptable ambient light color has chromaticity coordinates that are located on a Planckian locus on a chromaticity diagram.

15. The method defined in claim 13 wherein determining the ambient-adapted white point for the display comprises adjusting a color cast of the display to more closely match the acceptable ambient light color.

16. The method defined in claim 12 wherein determining the ambient-adapted white point for the display comprises adjusting a color cast of the display to more closely match the measured ambient light color in response to determining that the measured ambient light color is within the acceptable range of ambient light colors.

17. An electronic device, comprising:

a display;

a color ambient light sensor that gathers ambient light data; and display control circuitry that determines a measured ambient light color based on the ambient light data, maps the measured ambient light color to an adjusted ambient light color, and adjusts a color cast of the display based on the adjusted ambient light color, wherein the adjusted ambient light color and the measured ambient light color have the same color temperature, and wherein the adjusted ambient light color is less saturated than the measured ambient light color.

18. The electronic device defined in claim 17 wherein the display control circuitry adjusts the color cast of the display to more closely match the adjusted ambient light color.

19. The electronic device defined in claim 17 wherein the color ambient light sensor comprises a red detector that outputs red values, a green detector that outputs green values, and a blue detector that outputs blue values, and wherein the display control circuitry determines the color temperature of the ambient light based on the red, green, and blue values.

* * * * *